US007360592B2

(12) United States Patent
McMahan

(10) Patent No.: US 7,360,592 B2
(45) Date of Patent: Apr. 22, 2008

(54) COMPLIANT CLADDING SEAL/HANGER

(75) Inventor: Michael E. McMahan, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 227 days.

(21) Appl. No.: 11/110,210

(22) Filed: Apr. 20, 2005

(65) Prior Publication Data

US 2006/0237188 A1 Oct. 26, 2006

(51) Int. Cl.
*E21B 43/00* (2006.01)

(52) U.S. Cl. ..... 166/207; 166/206; 166/380

(58) Field of Classification Search ..... 166/207, 166/208, 206, 380
See application file for complete search history.

(56) References Cited

U.S. PATENT DOCUMENTS

| | | | | |
|---|---|---|---|---|
| 4,662,450 | A | 5/1987 | Haugen | |
| 4,832,125 | A * | 5/1989 | Taylor | 166/348 |
| 4,842,061 | A * | 6/1989 | Nobileau | 166/115 |
| 5,031,695 | A | 7/1991 | Cain et al. | |
| 5,031,696 | A | 7/1991 | Zwiegel | |
| 5,193,616 | A * | 3/1993 | Hynes | 166/208 |
| 5,799,730 | A | 9/1998 | Lam et al. | |
| 6,098,717 | A | 8/2000 | Bailey et al. | |
| 6,189,616 | B1 * | 2/2001 | Gano et al. | 166/298 |
| 6,390,201 | B1 | 5/2002 | Coon et al. | |
| 6,488,084 | B1 | 12/2002 | Borak, Jr. | |
| 6,691,789 | B2 * | 2/2004 | Jackson et al. | 166/384 |
| 6,896,049 | B2 * | 5/2005 | Moyes | 166/82.1 |
| 6,899,181 | B2 * | 5/2005 | Simpson et al. | 166/380 |
| 2004/0118572 | A1 * | 6/2004 | Whanger et al. | 166/384 |
| 2005/0057005 | A1 * | 3/2005 | Simpson et al. | 277/602 |

* cited by examiner

*Primary Examiner*—Jennifer H. Gay
*Assistant Examiner*—David Andrews
(74) *Attorney, Agent, or Firm*—Steve Rosenblatt

(57) ABSTRACT

A compliant, integrated, fastening and sealing system located on either end of cladding or on a liner hanger. It features protrusions in opposed directions whose contact edges are preferably hardened. The protrusions penetrate the surrounding tubular on expansion of the smaller tubular. Seals are included adjacent the protrusions so that seals between adjacent protrusions get forced toward each other upon flexing of the projections that penetrate the surrounding tubular. The attachment configuration is particularly suited for use with fixed swages or variable swages with limited dimensional adjustability when precise ID of host casing or open hole is unknown.

16 Claims, 1 Drawing Sheet

COMPLIANT CLADDING SEAL/HANGER

FIELD OF THE INVENTION

The field of this invention is tubulars that are expanded into surrounding tubulars for a support and sealing relationship.

BACKGROUND OF THE INVENTION

Frequently a patch is needed to isolate worn casing or a liner string needs to be inserted in casing and expanded into a sealing and supporting relationship with the surrounding tubular. Many times the specific dimensions of the surrounding tubular or the surrounding wellbore are unknown and the time and expense it takes to figure out the internal dimensions where the cladding or liner in what's known as a gauge run is not within the plans or budget of the well operator. The problem arises when the cladding is to be expanded with a fixed swage or a variable swage whose outer dimensions are not known to be sufficiently large to properly locate the cladding for sealing support in the wellbore or surrounding tubular.

Various techniques have been use to engage a seal between one tubular and a surrounding one. Some have employed the hanging weight of one tubular to energize a seal with the surrounding tubular. Some examples of such designs are U.S. Pat. Nos. 5,031,695; 5,031,696; 5,799,730 and 6,488,084. Other design employed explosive force or swaging such as U.S. Pat. Nos. 4,662,450 and 6,390,201. U.S. Pat. No. 6,098,717 shows the use of external seals on the inner tubular to be expanded into contact with the surrounding tubular for contact upon expansion.

What is lacking in the prior designs is an exterior treatment for the inner tubular that is compliant to adjust to the variability in inside dimensions to be encountered with the surrounding tubular or wellbore while at the same time being able to provide adequate support for loads in opposed directions and/or some interaction between a sealing member and the anchoring feature that preferably penetrates the outer tubular or wellbore wall. Those skilled in the art will better appreciate the scope of the invention from a review of the description of the preferred embodiment and the drawings, which appear below.

SUMMARY OF THE INVENTION

A compliant, integrated, fastening and sealing system located on either end of cladding or on a liner hanger. It features protrusions in opposed directions whose contact edges are preferably hardened. The protrusions penetrate the surrounding tubular on expansion of the smaller tubular. Seals are included adjacent the protrusions so that seals between adjacent protrusions get forced toward each other upon flexing of the projections that penetrate the surrounding tubular. The attachment configuration is particularly suited for use with fixed swages or variable swages with limited dimensional adjustability when precise ID of host casing or open hole is unknown.

DETAILED DESCRIPTION OF THE PREFERRED EMBODIMENT

Figure 1:
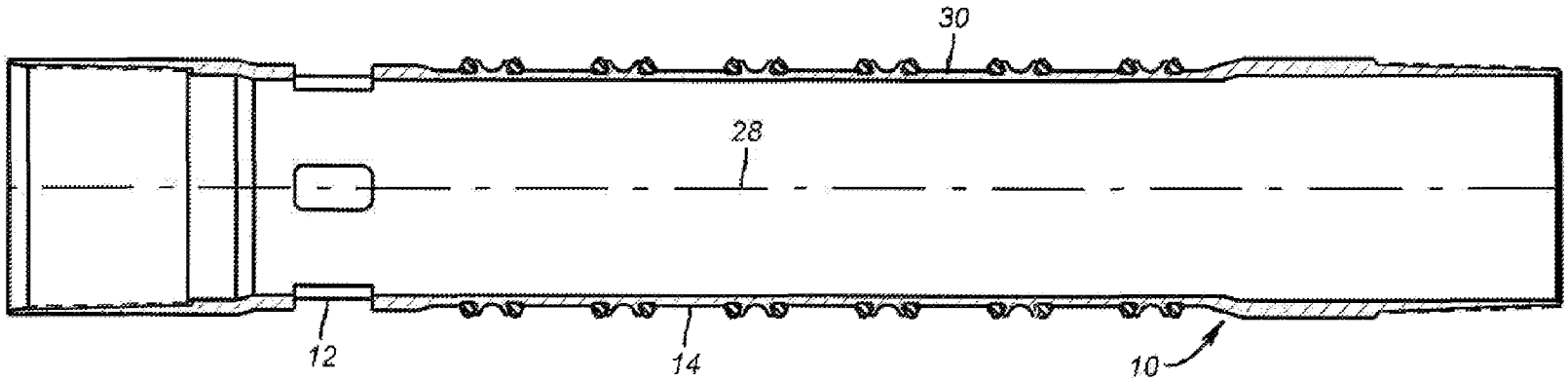
FIG. 1 is a section view of the cladding of the present invention.
Figure 2:
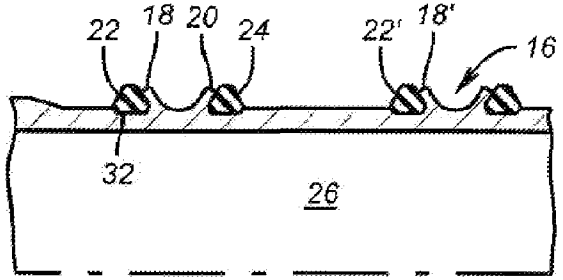
FIG. 2 is a closer view of the external surface of the cladding shown in FIG. 1.

Referring to FIG. 1 the cladding or tubular string 10 has openings 12 for attaching a running tool, not shown for placement in a wellbore that is also not shown. The exterior surface 14 has a series of projections 16 that are shown in more detail in FIG. 2. Projection 18 is oriented uphole and away from projection 20 that is oriented downhole. Seal ring 22 is uphole and adjacent projection 18 and seal ring 24 is located downhole from projection 20. In the preferred embodiment, the above described arrangement is presented in a repeating pattern. Accordingly, seals 24 and 22' are located between projections 20 and 18'.

Expansion of the cladding or tubular string 10 can be done by any one of a variety of known means from within passage 26. Projections 18 and 20 which define a U-shape are moved outwardly toward the surrounding tubular. The tips or contact points of the projections are preferably induction hardened and are designed to penetrate, preferably at least 0.030 inches, the wall of the surrounding tubular by extrusion of the softer host casing material. The projections can also flex depending on the dimension of the surrounding tubular and the size of the expanding tool employed in passage 26. When projections 18 and 20 flex away from each other they obtain a firmer grip on an adjacent seal such as 22 or 24. Seals 24 and 22' are pushed toward each other and at the same time are retained by their adjacent projections more forcefully to the bending combined with the penetration into the surrounding tubular.

Projections 18 and 20 can be blunt or sharply tipped. They can extend continuously around the circumference of the tubular or cladding 10 or they can be discontinuous. While the orientation of the projections 18 or 20 is shown at 90 degrees to the longitudinal axis 28 other orientations are possible including a continuous or segmented spiral pattern wrapping around outer surface 30. Seals 22 and 24 can be made of a material that is compatible with downhole fluids and temperature and can be mounted in a recess 32 to help better retain them to outer surface 30. Preferably the seals extend radially further out and away from longitudinal axis 28 than projections 18 or 20. Preferably, at least half the perimeter of the seals is engaged to the cladding or tubular 10 in the run in position. Penetration of the projections such as 20 and 22' along with potential deflection can push intervening seals toward each other and even into contact. The penetration of the projections eliminates the potential of seal extrusion in at least one direction. Seal pressure derived from inward flexing of projections such as 18 and 20 keeps a dynamic, constant resistive force against the projections to ensure they remain energized when external forces tend to push the cladding or liner hanger up or down.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claims, including the full range of equivalency to which each element thereof is entitled.

I claim:

1. An expandable tubular defining an outer wall for connection to a surrounding tubular or wellbore, said tubular having a longitudinal axis, comprising:

a plurality of projections on said outer wall defined by free ends that extend from said outer wall in different angular directions with respect to a plane that is perpendicular to said longitudinal axis, said projections penetrating the inner wall of the surrounding tubular or surface of the wellbore upon expansion of said outer wall;

said projections also flex with respect to said outer wall upon expansion thereof.

2. The tubular of claim 1, further comprising:

at least one seal adjacent at least one of said projections, said projection interacting with said seal upon expansion of said outer wall.

3. The tubular of claim 2, wherein:

said projection adjacent said seal retains said seal against extrusion in at least one direction upon expansion of said outer wall.

4. The tubular of claim 3, wherein:

said projections are disposed in pairs having free ends oriented in diverging directions.

5. The tubular of claim 2, wherein:

pressure derived from flexing of said projections applies a force against the projections to energize them to maintain contact against external forces in at least one of two opposed directions on the tubular.

6. The tubular of claim 1, wherein:

said projections are disposed in pairs having free ends oriented in diverging directions.

7. The tubular of claim 1, wherein:

said projections wrap around said outer wall in a continuous manner.

8. The tubular of claim 1, wherein:

said projections wrap around said outer wall in a discontinuous manner.

9. The tubular of claim 1, wherein:

said projections are oriented spirally around the longitudinal axis of the tubular.

10. The tubular of claim 1, wherein:

the amount of said penetration is at least 0.030 inches and said projections are hardened.

11. An expandable tubular defining an outer wall for connection to a surrounding tubular or wellbore, comprising:

a plurality of projections on said outer wall, said projections penetrating the inner wall of the surrounding tubular or surface of the wellbore upon expansion of said outer wall said projections also flex with respect to said outer wall upon expansion thereof;

at least two seals between a pair of projections whereupon deflection of at least one of said projections pushes said seals toward each other.

12. An expandable tubular defining an outer wall for connection to a surrounding tubular or wellbore, comprising:

a plurality of projections on said outer wall, said projections penetrating the inner wall of the surrounding tubular or surface of the wellbore upon expansion of said outer wall;

said projections also flex with respect to said outer wall upon expansion thereof;

at least one seal adjacent at least one of said projections, said projection interacting with said seal upon expansion of said outer wall;

said projection retains said seal against extrusion in at least one direction upon expansion of said outer wall;

said projections are disposed in pairs having free ends oriented in diverging directions;

at least two seals between a pair of projections whereupon deflection of at least one of said projections pushes said seals toward each other.

13. The tubular of claim 12, wherein:

said projections are oriented substantially perpendicularly to the longitudinal axis of the tubular.

14. The tubular of claim 13, wherein:

said projections wrap around said outer wall in a continuous manner.

15. The tubular of claim 13, wherein:

the amount of said penetration is at least 0.030 inches and said projections are hardened.

16. The tubular of claim 12, wherein:

pressure derived from flexing of said projections applies a force against the projections to energize them to maintain contact against external forces in at least one of two opposed directions on the tubular.

* * * * *